US011617924B2

(12) United States Patent
Feheley

(10) Patent No.: US 11,617,924 B2
(45) Date of Patent: Apr. 4, 2023

(54) DIRECT ALIGNMENT GOLF PUTTER

(71) Applicant: Patrick Joseph Feheley, Binghamton, NY (US)

(72) Inventor: Patrick Joseph Feheley, Binghamton, NY (US)

( * ) Notice: Subject to any disclaimer, the term of this patent is extended or adjusted under 35 U.S.C. 154(b) by 0 days.

(21) Appl. No.: 17/842,497

(22) Filed: Jun. 16, 2022

(65) Prior Publication Data

US 2022/0305350 A1 Sep. 29, 2022

Related U.S. Application Data

(63) Continuation-in-part of application No. 16/873,105, filed on Feb. 3, 2020, now abandoned.

(51) Int. Cl.

| | |
|---|---|
| ***A63B 69/36*** | (2006.01) |
| ***A63B 53/04*** | (2015.01) |
| ***A63B 53/00*** | (2015.01) |

(52) U.S. Cl.

CPC ..... *A63B 53/0433* (2020.08); *A63B 53/007* (2013.01); *A63B 53/0487* (2013.01); *A63B 2053/0491* (2013.01)

(58) Field of Classification Search

None

See application file for complete search history.

(56) References Cited

U.S. PATENT DOCUMENTS

| | | | | |
|---|---|---|---|---|
| 2,110,925 A | | 3/1938 | Tanner | |
| 3,751,819 A | * | 8/1973 | Dixon | A63B 69/3676 33/334 |
| 4,700,949 A | | 10/1987 | Nottoli | |
| 4,756,535 A | | 7/1988 | Bradley | |
| 5,207,721 A | * | 5/1993 | Lobdell | A63B 69/3685 473/230 |
| 5,643,098 A | * | 7/1997 | Monahan | A63B 69/3685 473/230 |
| 6,152,832 A | * | 11/2000 | Chandler, III | A63B 53/007 473/313 |
| 6,547,672 B1 | * | 4/2003 | Chough | A63B 69/3685 473/340 |
| 6,767,292 B1 | | 7/2004 | Skalla | |
| 7,172,513 B1 | * | 2/2007 | Rinker | A63B 53/065 473/238 |
| 7,481,714 B2 | * | 1/2009 | Blanchard | A63B 69/3685 473/251 |
| 9,480,886 B2 | * | 11/2016 | Sridhar | A63B 53/0487 |
| 2004/0147337 A1 | * | 7/2004 | Cosmo | A63B 69/3676 473/330 |
| 2004/0259654 A1 | * | 12/2004 | Failla | A63B 53/007 473/230 |
| 2008/0009362 A1 | * | 1/2008 | Burns | A63B 60/00 473/293 |

* cited by examiner

*Primary Examiner* — Sunit Pandya

(74) *Attorney, Agent, or Firm* — Olav M. Underdal; IDP Patent Services

(57) ABSTRACT

A golf putter includes a putting head including a putting head body, configured with a flat bottom surface, a rear ward angled hosel aperture and a rear angled flat surface; left and right indentations for receiving weights, and left and right detachable wheels attached on sides of the putting head body, such that the putting head is configured to be slidable along a putting surface to enable a golfer to line up the putting head, a golf ball, and a target cup in a front of the golfer, in order to hit the golf ball with a forward sliding motion of the putting head.

21 Claims, 8 Drawing Sheets

Golf putter

DIRECT ALIGNMENT GOLF PUTTER

CROSS-REFERENCE TO RELATED APPLICATIONS

This application is a Continuation-In-Part of U.S. Non-Provisional application Ser. No. 16/873,105, filed Feb. 3, 2020; which is hereby incorporated herein by reference in its entirety.

FIELD OF THE INVENTION

The present invention relates generally to the field of golf putting, and more particularly to methods and systems for stroking a putt that puts the golfer, the ball, the putting device and the cup in direct (straight on) alignment.

BACKGROUND OF THE INVENTION

Current putting devices are operated with the golfer in suboptimal alignment, with the golfer stroking the ball at a 90-degree angle relative to the hole and the positioning of their body. Presently there are only limited solutions available for stroking a putt that puts the golfer, the ball, the putting device and the cup in direct (straight on) alignment As such, considering the foregoing, it may be appreciated that there continues to be a need for novel and improved devices and methods for golf putters.

SUMMARY OF THE INVENTION

The foregoing needs are met, to a great extent, by the present invention, wherein in aspects of this invention, enhancements are provided to the existing model of golf putters.

In an aspect, a golf putter can include:

a) A putting shaft;

b) A putting head, which can include:

- i. A putting head body, which comprises a bottom sliding surface, which can be substantially flat, wherein the putting head body can include:
  - 1. A front body, which can include a front face; and
  - 2. a rear body, which can include
  - 3. a hosel aperture, such that the hosel aperture is configured with a shaft rearward angle in a range of 30 to 60 degrees such that the hosel aperture is configured to receive an inner end of the putting shaft;
- ii. a left wheel, which can be detachably and rotatably connected to a left side of the rear body;
- iii. a right wheel, which can be detachably and rotatably connected to a right side of the rear body;

wherein an inner end of the putting shaft is mounted in the hosel aperture;

wherein the rear body can be narrower than the front body, such that the left and right wheels are recessed behind the front body, such that left and right sides of respectively the left and right wheels are within longitudinal vertical planes of respectively left and right sides of the front body;

such that the putting head is configured to be slidable along a putting surface to enable a golfer to line up the putting head, a golf ball, and a target cup in a front of the golfer, in order to hit the golf ball with a forward sliding motion of the putting head.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

Figure 1:
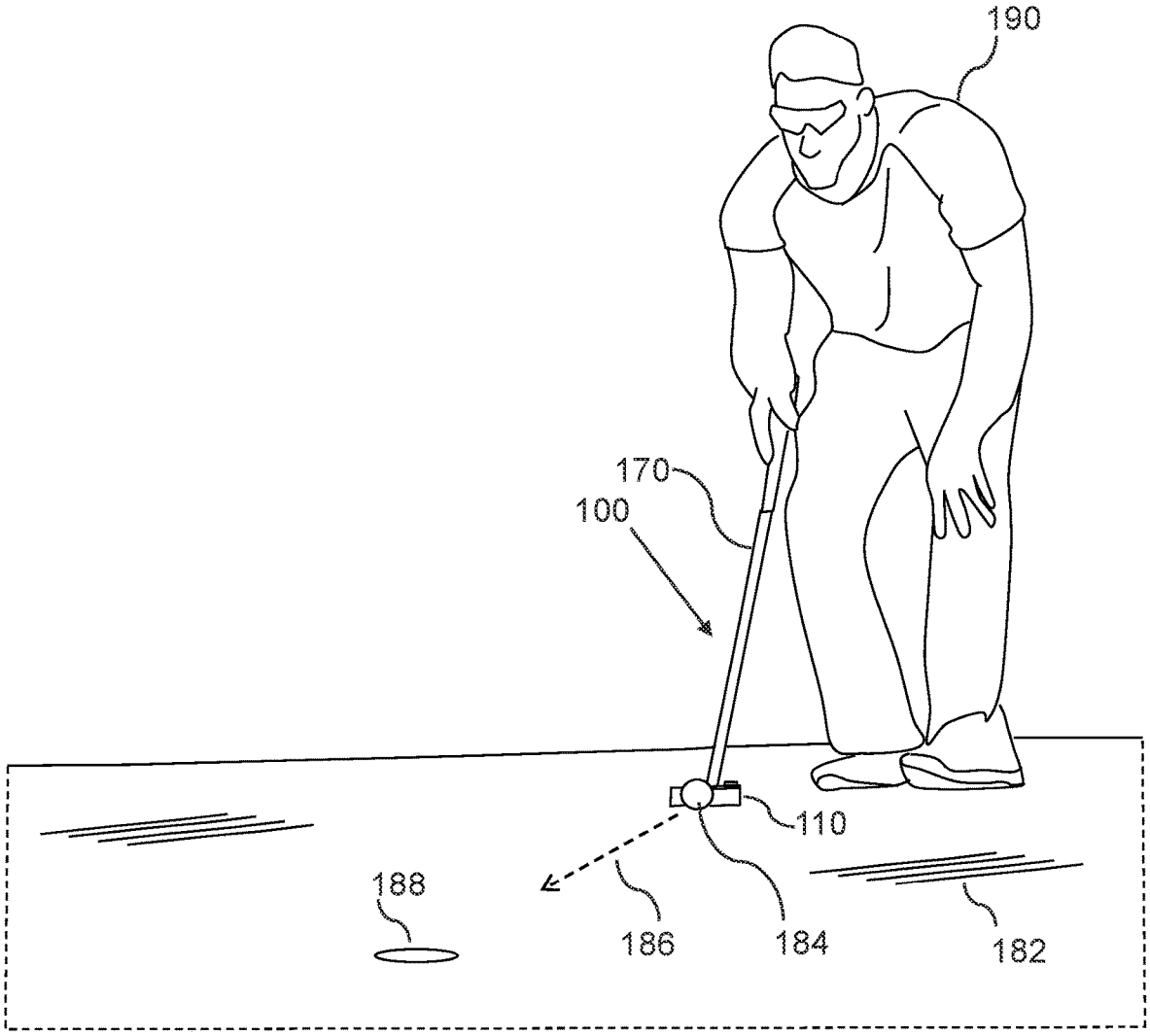
FIG. 1 is a perspective view of a direct alignment golf putter in use by a golf player, according to an embodiment of the invention.

In the following, we describe the structure of an embodiment of a direct alignment golf putter 100 with reference to FIG. 1, in such manner that like reference numerals refer to like components throughout; a convention that we shall employ for the remainder of this specification.

In various related embodiments, the direct alignment golf putter 100 relates to the way someone engaged in putting interacts with the golf ball. The present invention also intends to allow those with certain disabilities a new tool allowing them access to the game of golf.

In various related embodiments, the direct alignment golf putter 100 allow a golfer to both arrange their body in a straight line and stroke the ball in this direct alignment with the cup. This direct alignment increases proprioceptive connection between the golfer, the putting device, the ball and the cup. This direct alignment opens the door to a new dimension of accuracy in the putting aspect for the game of golf.

Thus, in related embodiments, the direct alignment golf putter 100 allows the golf enthusiast to experience an unprecedented proprioceptive connection between themselves and the cup. The present invention, in the field of putting in the game of golf, allows golf players 190 to more directly aim their putting strokes via positioning of their body, present invention, golf ball and hole in a straight line as shown in FIG. 1.

Figure 3A:
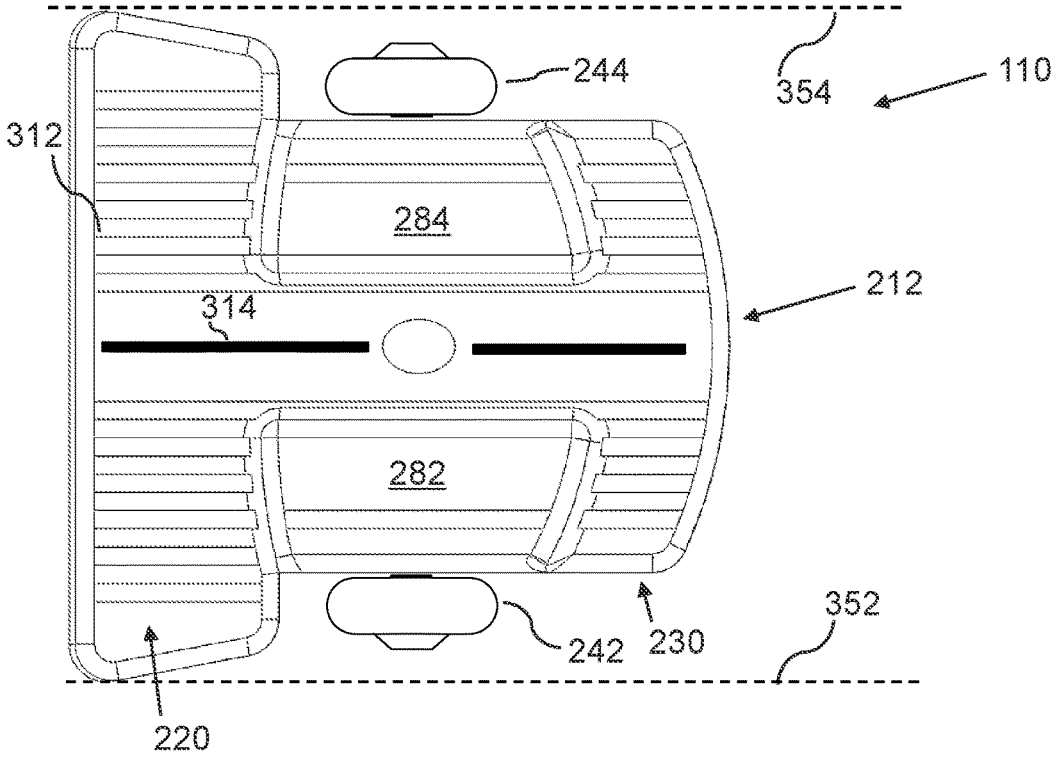
FIG. 3A is a top view of a putting head, according to an embodiment of the invention.
Figure 5A:
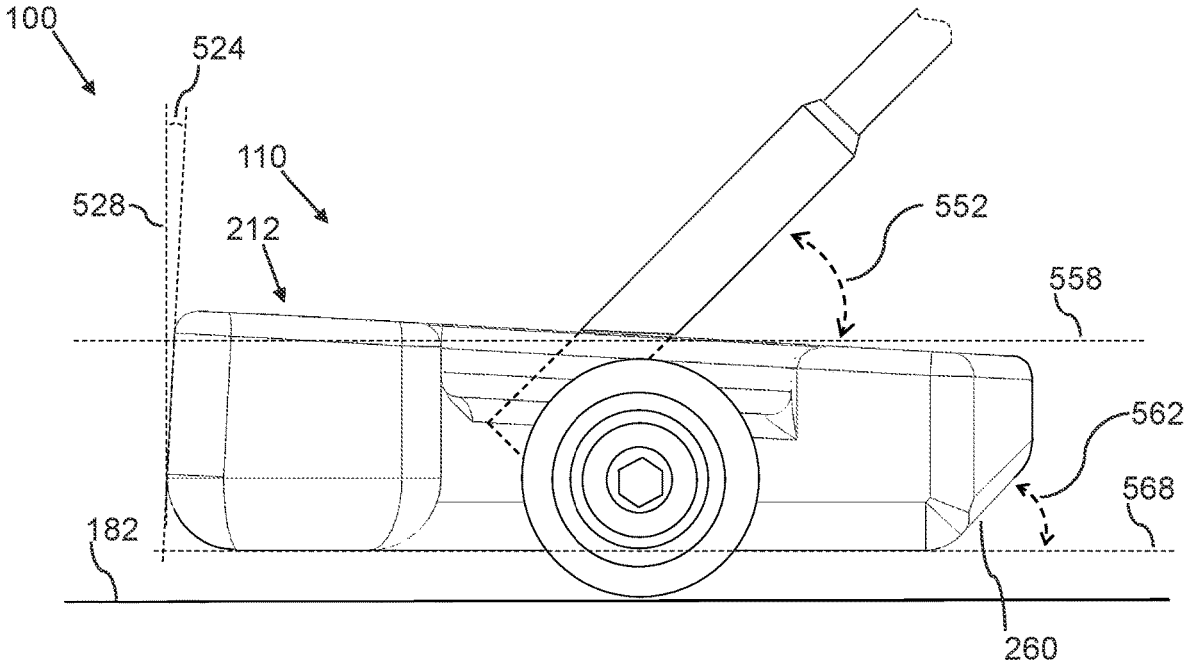
FIG. 5A is a side view of a direct alignment golf putter, according to an embodiment of the invention.
Figure 5B:
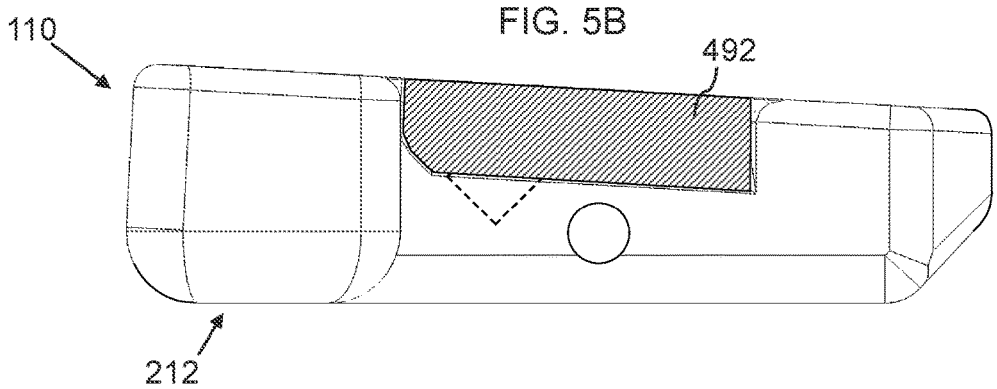
FIG. 5B is a side view of a putting head with weights mounted, according to an embodiment of the invention.
Figure 5C:
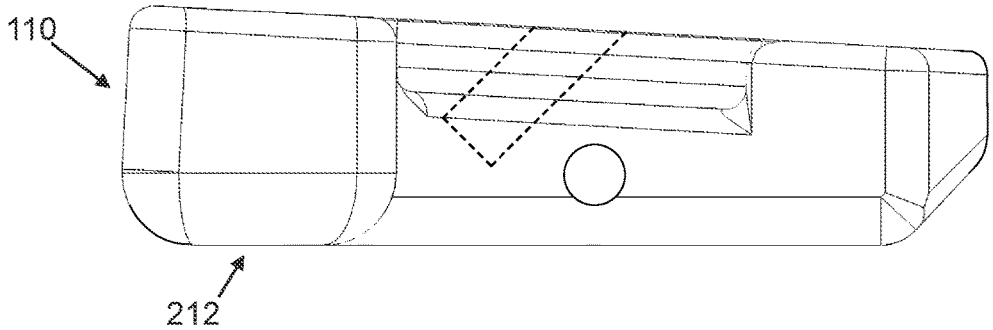
FIG. 5C is a side view of a putting head, according to an embodiment of the invention.

In an embodiment a golf putter 100 can include:

a) A putting shaft 170;

b) A putting head 110, which can include:

i. A putting head body 212, which comprises a bottom sliding surface, which can be substantially flat, wherein the putting head body 212 can include:

1. A front body 220, which can include a front face 222, which can be flat and angled at a front face vertical angle 524, which can be in a range of 1-5 degrees, such as substantially 3 degrees (relative to a vertical reference line 528, when a bottom of the putting head body 212 is parallel with the ground or horizontal reference line 558, 568), as shown in FIG. 5A; and 2. A rear body 230, which is connected to a rear side of the front body 220;

3. A hosel aperture 232, which can be centrally positioned a long a longitudinal centerline 234 of the putting head 110; such that the hosel aperture 232 is configured with a shaft rearward angle 552 of 45 degrees or in a range of 30 to 60 degrees (relative to a horizontal reference line 558, when a bottom of the putting head body 212 is parallel with the ground or horizontal reference line 558), such that the hosel aperture 232 is configured to receive an inner end of the putting shaft 170;

ii. a left wheel 242, which can be detachably and rotatably connected to a left side of the rear body 230;

iii. a right wheel 244, which can be detachably and rotatably connected to a right side of the rear body 230;

wherein the left wheel 242 and the right wheel 244 are detachable, such that the golf putter 100 is configurable for use with or without the left wheel 242 and the right wheel 244;

wherein an inner end of the putting shaft 170 is mounted in the hosel aperture 232;

wherein the rear body 230 can be narrower than the front body 220, such that the left and right wheels 242, 244 are recessed behind the front body 220, such that left and right sides of respectively the left and right wheels 242, 244 are within longitudinal vertical planes 352, 354 of respectively left and right sides of the front body 220, as shown in FIG. 3A;

such that the putting head 110 is configured to be slidable along a putting surface 182 to enable a golfer 190 to line up the putting head 110, a golf ball 184, and a target cup 188 in a front of the golfer 190, in order to hit the golf ball 184 with a forward sliding motion 186 of the putting head 110.

Figure 2A:
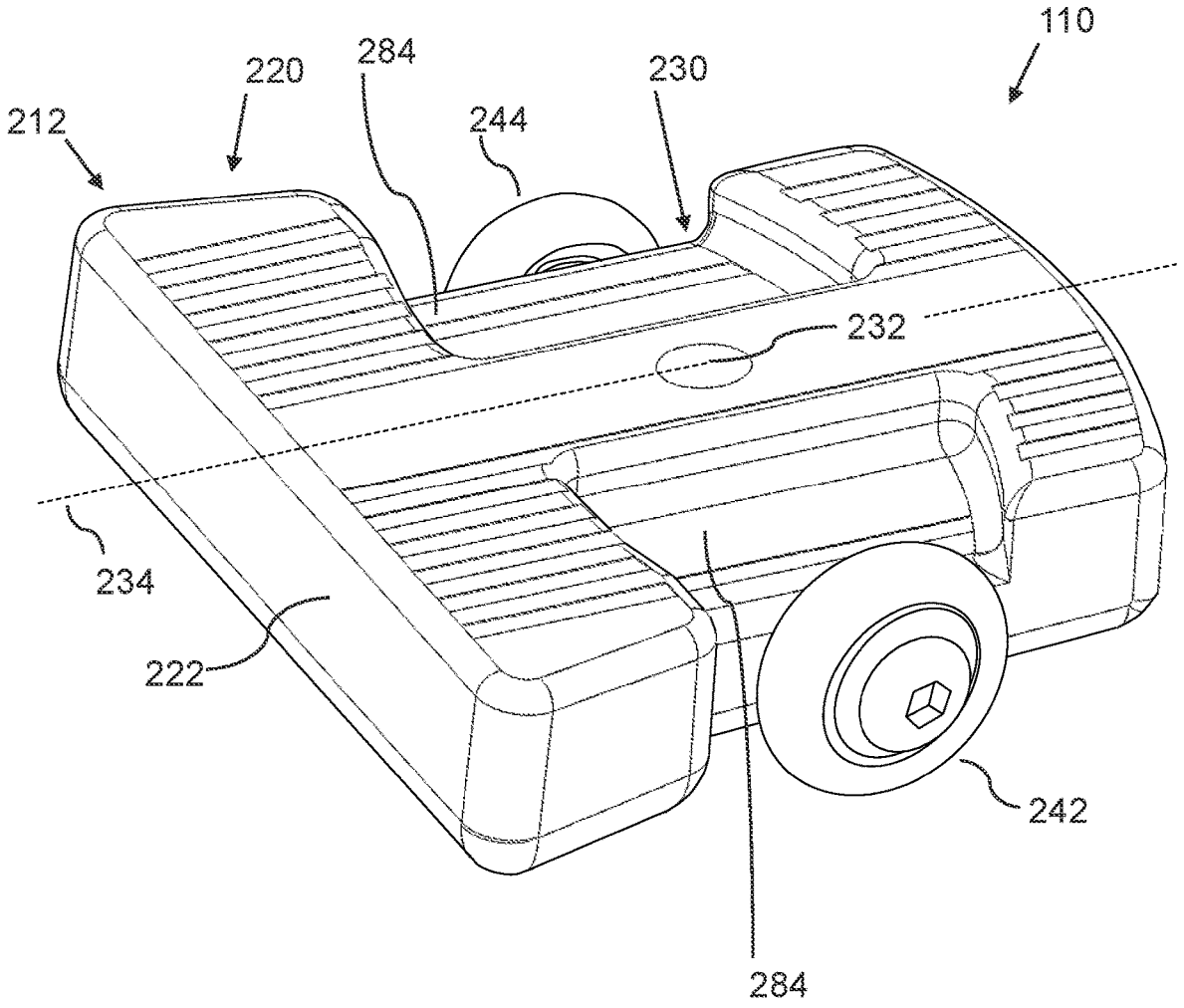
FIG. 2A is a front top perspective view of a putting head, according to an embodiment of the invention.
Figure 2B:
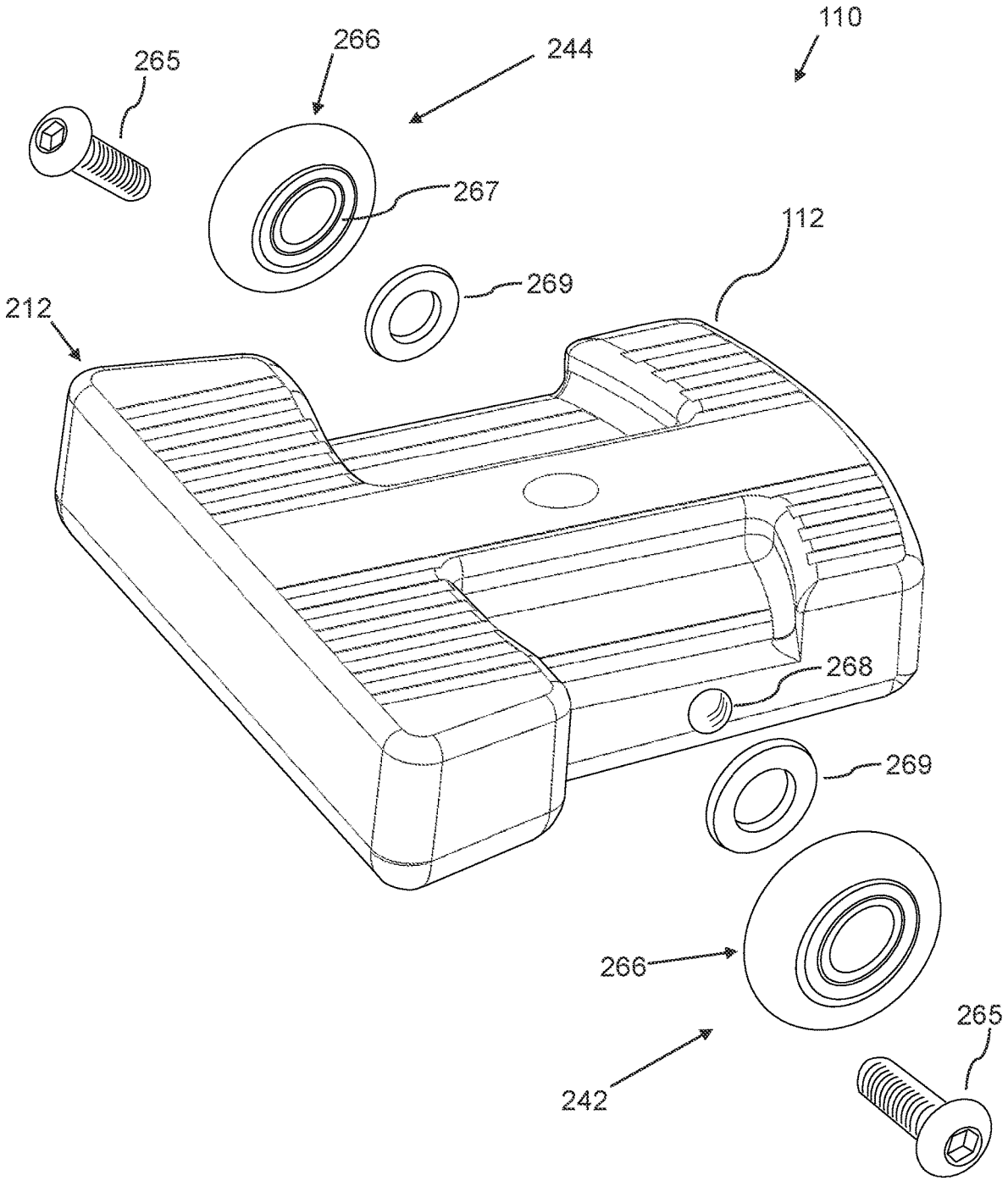
FIG. 2B is a front top perspective view of a putting head with the wheels detached from the putting head body, according to an embodiment of the invention.
Figure 2C:
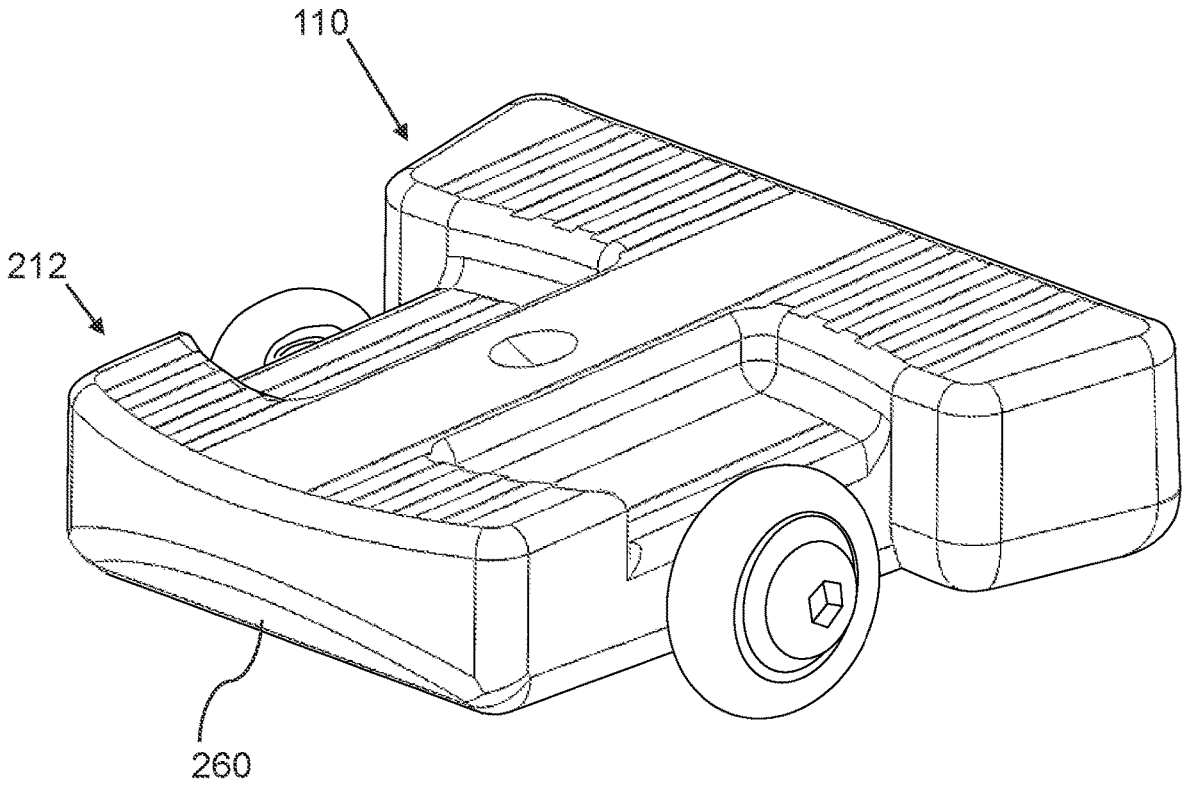
FIG. 2C is a rear top perspective view of a putting head, according to an embodiment of the invention.
Figure 2D:
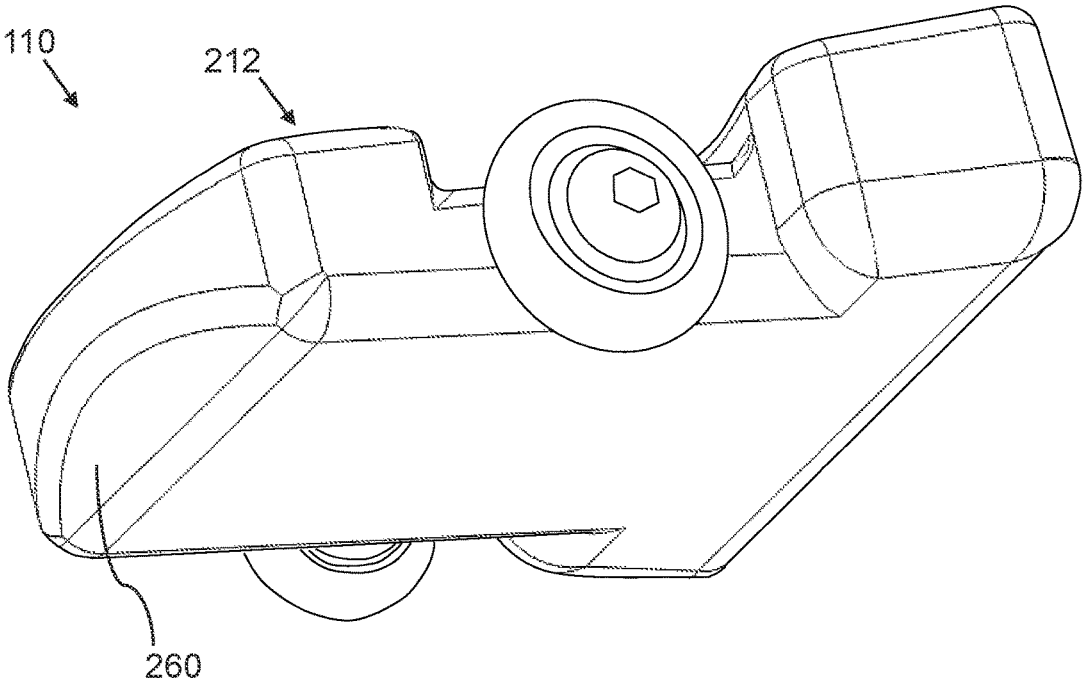
FIG. 2D is a rear bottom perspective view of a putting head, according to an embodiment of the invention.

In a related embodiment, as shown in FIG. 2B, the left and right wheels 242, 244 can each include a wheel body 266 and a bearing 267 that is rotatably mounted in a center of the wheel body 266, such that the left and right wheels 242, 244 can each be secured with a threaded screw 265, which screws into a threaded aperture 268 in a side of the putting head body 212. A spacer 269 can be positioned between the wheel 242, 244 and the putting head body 212, to ensure free rotation of the wheel 242, 244. Alternatively, other well-known methods for detachable mounting of rotatable wheels 242, 244 can be used, such as including using of a rotatable or non-rotatable axle.

Figure 2E:
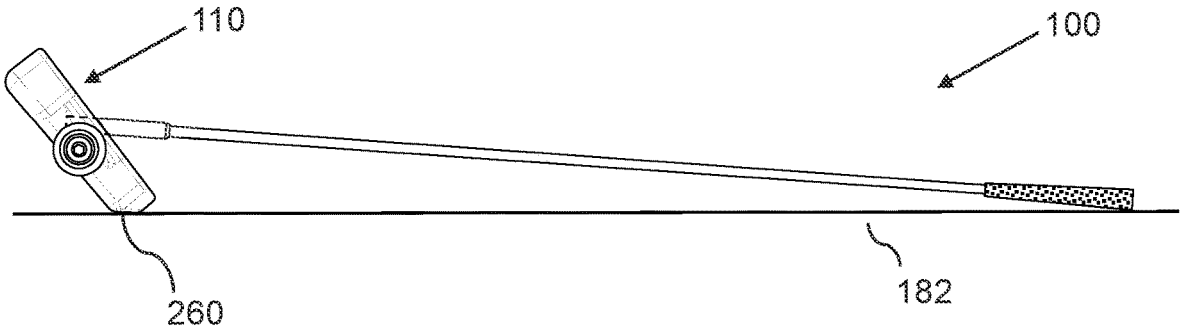
FIG. 2E is a side view of a direct alignment golf putter positioned on a putting surface, according to an embodiment of the invention.

In another related embodiment, as shown in FIGS. 2C, 2D, 2E, and 5A, the putting head body 212 can be configured to include:

a) a rear angled flat surface 260, which is positioned in a rear bottom end of the putting head body 212, wherein the rear angled flat surface 260 is oriented at a rearward surface angle 562 (relative to a horizontal reference line 568, when a bottom of the putting head body 212 is parallel with the ground or horizontal reference line 568) of approximately 45 degrees, or in a range of 25 to 60 degrees;

such that the rearward surface angle 562 can be at least 1 to 3 degrees smaller than the shaft rearward angle 452, such that the rear angled flat surface 260 is configured to stabilize the direct alignment golf putter 100 to aid in target visualization when the direct alignment golf putter 100 is positioned along the ground with the rear angled flat surface touching the putting surface, as shown in FIG. 2E, such that the rear angled flat surface 260 is lying substantially flat on the putting surface 182, when the direct alignment golf putter 100 is positioned on the ground with the rear angled flat surface touching the putting surface.

Figure 3B:
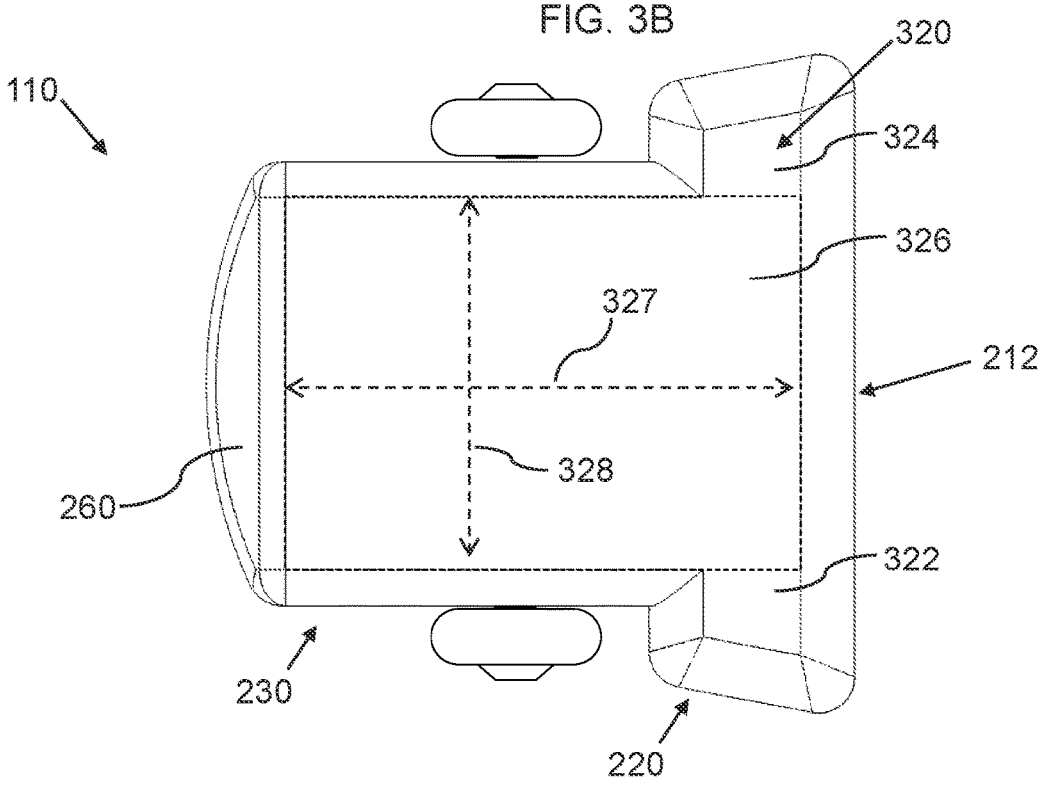
FIG. 3B is a bottom view of a putting head, according to an embodiment of the invention.

In a related embodiment, as shown in FIG. 3B, a combined bottom surface 320 of the putting head 110 (formed by bottom surfaces of the front body 220 and the rear body 230) can be flat and can include:

a) a rectangular bottom surface 326 that is elongated in a longitudinal direction, such that a longitudinal length 327 of the rectangular bottom surface 326 is greater than a lateral width 328 of the rectangular bottom surface 326;

b) a front left bottom surface 322, which is a left portion of a bottom surface of the front body 220, such that the front left bottom surface 322 is connected to a front left side of the rectangular bottom surface 326; and c) a front right bottom surface 324, which is a right portion of the bottom surface of the front body 220, such that the front right bottom surface 324 is connected to a front right side of the rectangular bottom surface 326;

such that the bottom sliding surface is substantially t-shaped (as shown in FIG. 3B, typically with a relatively wide vertical stem and relatively narrow and short front lateral protruding parts);

such that a width of the putting head 110 (i.e., a width of the front body 220) is typically larger than a length of the putting head 110, to comply with golf regulations;

such that the elongated shape of the rectangular bottom surface 326 in combination with the front left bottom surface 322 and the front right bottom surface 324 enables an enhanced sliding capability of the putting head 110 on the putting surface 182 (and such that the lateral protruding parts cover are in a front of the wheels).

Figure 4A:
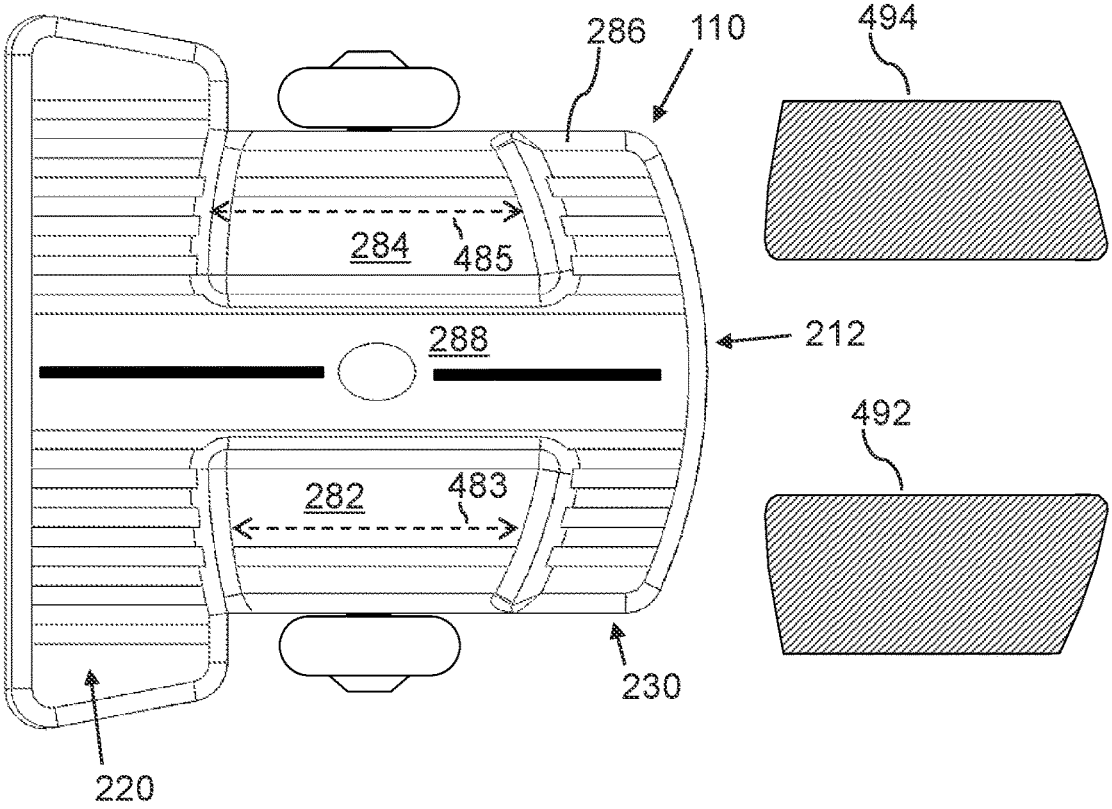
FIG. 4A is a top view of a putting head with detached weights, according to an embodiment of the invention.
Figure 4B:
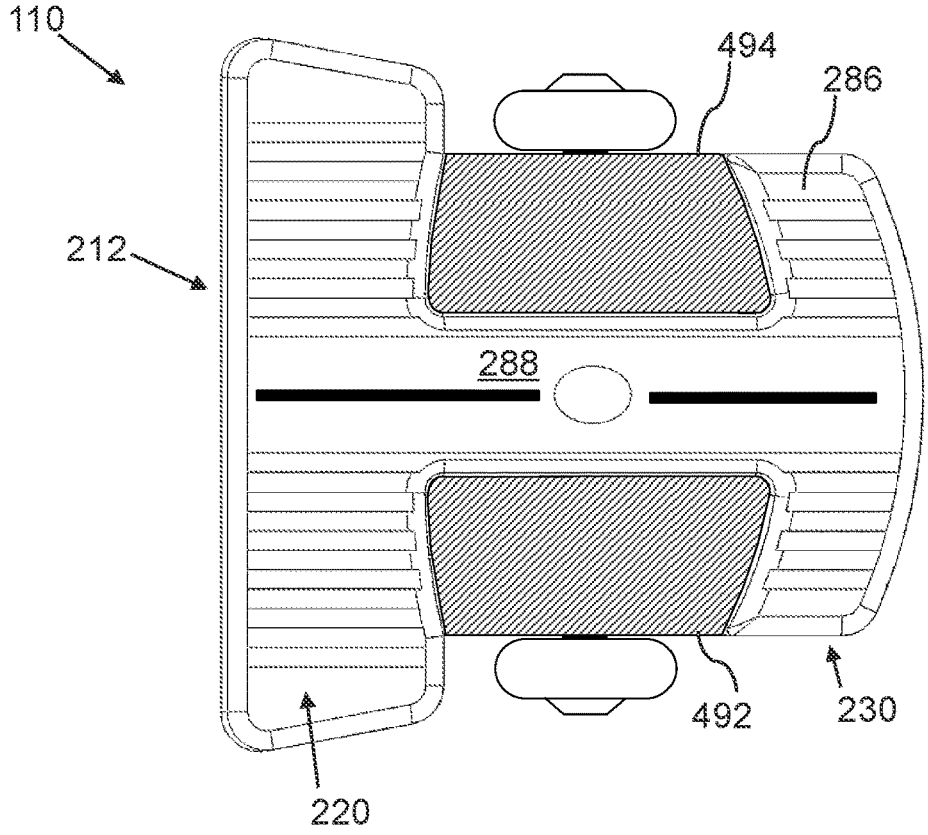
FIG. 4B is a top view of a putting head with weights mounted, according to an embodiment of the invention.

In a related embodiment, as shown in FIGS. 2A, 4A and 4B, the rear body 230 can further include:

a) a left side indentation 282, which can be positioned in a top left side of the rear body 230 of the putting head body 212, wherein the left side indentation 282 can be configured with an inward expanding left side length 483;

b) a right side indentation 284, which can be positioned in a top right side of the rear body 230 of the putting head body 212, wherein the right side indentation 284 can be configured with an inward expanding right side length 485; and c) a rear portion 286, which can be substantially higher than bottoms of the left side indentation 282 and the right side indentation 284; and d) a center portion 288, which is positioned between the left side indentation 282 and the right side indentation 284, such that the center portion 288 is connected between a center of the front body 220 and a center of the rear portion 286.

such that the left side indentation 282 is configured to removably receive a left side weight 492, such that the inward expanding left side length 483 is configured to prevent the left side weight 492 from sliding out laterally, when the left side weight 492 is removably mounted in the left side indentation 282;

such that the right side indentation 284 is configured to removably receive a right side weight 494, such that the inward expanding right side length 485 is configured to prevent the right side weight 494 from sliding out laterally, when the right side weight 494 is removably mounted in the right side indentation 284.

In a further related embodiment, the left and right side weights 492, 494 can be made with a center core of metal and with a surface of rubber or plastic. the left and right side weights 492, 494 can be held in place by the inward narrowing shape of the left and right side indentations 282, 284, respectively, and can be further secured with hook and loop fastener or a snap lock fastener, or other types of fasteners.

In a related embodiment, the putting head body 212 can be made of wood, wherein the bottom sliding surface of the putting head body 212 is surface treated (i.e., stained/impregnated and polished) with an oil, to create a smooth low friction gliding surface, wherein the oil can include a linseed oil. Other lubricants can be applied to the bottom sliding surface of the putting head body 212, such as grease, paraffin, or silicone, including silicone applied with a spray.

In a related embodiment, as shown in FIG. 3A, an upper surface of the putting head 110 can include:

a) at least one elongated longitudinal marking 312, 314, which can be configured as a print label or print marking 312, or as an elongated protrusion 314, which is longitudinally oriented, whereby the at least one elongated protrusion aid the golfer 190 in aiming the sliding motion toward the target cup 188.

In related embodiments, the direct alignment golf putter 100 can be placed flat on the green thereby helping steadying a disabled or any unsteady golfer 190. The Golfer looks straight at the cup, as the direct alignment golf putter 100 slides smoothly on the green. The Golfer slides the putter back and then forward to stroke the ball straight forward on a putting line to the cup.

With conventional golf clubs, the golf player has to stand sideways to the ball to hit drives, use irons, or putters. However, using the direct alignment golf putter 100, the gold player stands behind the ball and slides the direct alignment golf putter 100 forward on the green to strike the ball with one hand, aiming straight at the Cup. The golf player is looking straight down the putter shaft and looking straight at the Cup and hit the ball straight forward (i.e., not sideways as with conventional putters).

In various related embodiments, speed and direction are two critical factors that determine the success of a putt. Direction is greatly influenced (85%) by where the putter face is pointed at contact with the ball. Path of the stroke is responsible for 15% directionally. The direct alignment golf putter 100 makes correct aiming of the face, at the target, simple as the player is positioned behind the ball and on the intended line of the putt. Maintaining accurate face direction throughout the stroke is the most difficult, and critical, aspect of putting due to the natural arcing of a traditional style stroke. Resulting in an unreliable method for striking the ball consistently on the planned line. The linear, non-arcing, stroke manner used with the direct alignment golf putter 100 virtually eliminates misdirected putts. direct alignment golf putters 100 make starting the ball on the target line uncomplicated and effortless.

In related embodiments, the direct alignment golf putter 100 can be made with using an aluminum mold is made. A dense polymer is then injected into the mold with a 60-ton injection molding machine to form the club head. To form the 1" long ⅜" wide hosel opening for shaft emplacement (FIG. 1 #4), an insert with the same measurements is placed inside the mold during injection process. After the mold is open and formed invention club head is ejected, this insert is removed. The club shaft is secured into remaining hosel opening with epoxy resin. This shaft is mounted at a 45-degree angle relative to vertical and aligned directly with the midline of the club head, perpendicular to the club face. The bottom of the club head as seen in FIG. 6 is highly polished to create an extremely low friction surface, allowing the club head to slide freely over the play surface.

Thus, in various related embodiments, the linear orientation of the user combined with a straight forward sliding stroke motion presents a novel new way to strike a golf ball toward the hole/target. By utilizing a linear line of site between the user's eyes, the direct alignment golf putter 100, the golf ball and the cup, this modern orientation of the golfer is similar to a marksman, the rifle, aiming site/scope and the bull's-eye of his target. While transversely rotating the body 90 degrees left or right (depending on handedness) compared to what has come before and incorporating the direct alignment golf putter 100 presented here, a new dimension in putting is opened, more accurately matching a golf player's natural connection between their stance and aim. In nearly every other sport, this similar stance stoke/throw/shot is linear and constant due to its recognized effectiveness.

In related embodiments, the direct alignment golf putter 100 provides those with disabilities a new tool to regain their capability of putting on a golf course, mini golf course or indoor putting game. Disabilities, such as missing a limb, requiring a wheelchair, lacking stability, or lacking balance, are not impediments to enjoying full use of the direct alignment golf putter 100.

Here has thus been described a multitude of embodiments of the direct alignment golf putter 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

For example, many versions of the invention can be built with different club head ornamental design a visual aesthetics, and with different materials suitable for construction of a putting head.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A golf putter, comprising:

a putting head, comprising:

a putting head body, which comprises a bottom sliding surface, which is flat, wherein the putting head body further comprises:

a front body, which comprises:

a front face; and a rear body, which is connected to a rear side of the front body;

a left wheel, which is rotatably connected to a left side of the putting head body;

a right wheel, which is rotatably connected to a right side of the putting head body;

wherein the rear body is narrower than the front body, such that the left wheel and the right wheel are recessed behind the front body, such that left and right sides of respectively the left wheel and the right wheel are within longitudinal vertical planes of respectively left and right sides of the front body;

such that the putting head is configured to be slidable along a putting surface to enable a golfer to line up the putting head, a golf ball, and a target cup in a front of the golfer, in order to hit the golf ball with a forward sliding motion of the putting head.

2. The golf putter of claim 1, wherein the left wheel and the right wheel are detachable, such that the golf putter is configurable for use with or without the left wheel and the right wheel.

3. The golf putter of claim 1, wherein the putting head body further comprises:

a hosel aperture, which is centrally positioned along a longitudinal centerline of an upper surface of the putting head body;

such that the hosel aperture is configured to receive an inner end of a putting shaft;

such that the hosel aperture is configured with a shaft rearward angle in a range of 30 to 60 degrees.

4. The golf putter of claim 3, wherein the shaft rearward angle is 45 degrees.

5. The golf putter of claim 3, wherein the putting head body further comprises:

a rear angled flat surface, which is positioned in a rear bottom end of the putting head body, wherein the rear angled flat surface is oriented at a rearward surface angle in a range of 25 to 60 degrees;

such that the rear angled flat surface is configured to stabilize the golf putter to aid in target visualization when the golf putter is positioned along the putting surface with the rear angled flat surface touching the putting surface.

6. The golf putter of claim 5, wherein the rearward surface angle is at least 1 degree smaller than the shaft rearward angle, such that the rear angled flat surface is configured to lie flat on the putting surface when the golf putter is positioned along the putting surface with the rear angled flat surface touching the putting surface.

7. The golf putter of claim 1, wherein the bottom sliding surface of the putting head further comprises:

a rectangular bottom surface that is elongated in a longitudinal direction, such that a longitudinal length of the rectangular bottom surface is greater than a lateral width of the rectangular bottom surface.

8. The golf putter of claim 7, wherein the bottom sliding surface of the putting head further comprises:

a) a front left bottom surface, such that the front left bottom surface is connected to a front left side of the rectangular bottom surface; and b) a front right bottom surface, such that the front right bottom surface is connected to a front right side of the rectangular bottom surface;

such that the bottom sliding surface is t-shaped.

9. The golf putter of claim 1, wherein the putting head body is made of wood, wherein the bottom sliding surface of the putting head body is surface treated with an oil.

10. The golf putter of claim 9, wherein the oil comprises a linseed oil.

11. The golf putter of claim 1, wherein the putting head body further comprises:

a) a left side indentation; and b) a right side indentation;

such that the left side indentation is configured to removably receive a left side weight; and such that the right side indentation is configured to removably receive a right side weight.

12. The golf putter of claim 11, wherein:

a) the left side indentation is configured with an inward expanding left side length;

b) the right side indentation is configured with an inward expanding right side length; and such that the inward expanding left side length is configured to prevent the left side weight from sliding out laterally, when the left side weight is mounted in the left side indentation;

such that the inward expanding right side length is configured to prevent the right side weight from sliding out laterally, when the right side weight is mounted in the right side indentation.

13. The golf putter of claim 11, further comprising:

a) the left side weight, which is removably mounted in the left side indentation;

b) the right side weight, which is removably mounted in the right side indentation.

14. A golf putter, comprising:

a putting head, comprising:

a putting head body, which comprises:

a bottom sliding surface, which is flat;

a left side indentation; and a right side indentation;

such that the left side indentation is configured to removably receive a left side weight; and such that the right side indentation is configured to removably receive a right side weight;

such that the putting head is configured to be slidable along the putting surface to enable a golfer to line up the putting head, a golf ball, and a target cup in a front of the golfer, in order to hit the golf ball with a forward sliding motion of the putting head.

15. The golf putter of claim 14, wherein the putting head further comprises:

a) a left wheel, which is rotatably connected to a left side of the putting head body;

b) a right wheel, which is rotatably connected to a right side of the putting head body;

wherein the left wheel and the right wheel are detachable, such that the golf putter is configurable for use with or without the left wheel and the right wheel.

16. The golf putter of claim 15, wherein the putting head body comprises:

a) a front body, which comprises a front face; and b) a rear body, which is connected to a rear side of the front body;

wherein the rear body is narrower than the front body, such that the left wheel and the right wheel are recessed behind the front body, such that left and right sides of respectively the left wheel and the right wheel are within longitudinal vertical planes of respectively left and right sides of the front body.

17. The golf putter of claim 14, wherein a combined bottom surface of the putting head is flat and further comprises:

a rectangular bottom surface that is elongated in a longitudinal direction, such that a longitudinal length of the rectangular bottom surface is greater than a lateral width of the rectangular bottom surface.

18. The golf putter of claim 17, wherein the bottom sliding surface of the putting head further comprises:

a) a front left bottom surface, such that the front left bottom surface is connected to a front left side of the rectangular bottom surface; and b) a front right bottom surface, such that the front right bottom surface is connected to a front right side of the rectangular bottom surface;

such that the bottom sliding surface is t-shaped.

19. The golf putter of claim 14, wherein the putting head body further comprises:

a hosel aperture, which is centrally positioned along a longitudinal centerline of an upper surface of the putting head body;

such that the hosel aperture is configured to receive an inner end of a putting shaft;

such that the hosel aperture is configured with a shaft rearward angle in a range of 30 to 60 degrees.

20. The golf putter of claim 19, wherein the rearward surface angle is at least 1 degree smaller than the shaft rearward angle, such that the rear angled flat surface is configured to lie flat on the putting surface when the golf putter is positioned along the putting surface with the rear angled flat surface touching the putting surface.

21. A golf putter, comprising:

a putting head, comprising:

a putting head body, which comprises a bottom sliding surface, which is flat;

a left wheel, which is rotatably connected to a left side of the putting head body;

a right wheel, which is rotatably connected to a right side of the putting head body;

a left side indentation; and a right side indentation;

such that the left side indentation is configured to removably receive a left side weight; and such that the right side indentation is configured to removably receive a right side weight;

such that the putting head is configured to be slidable along a putting surface to enable a golfer to line up the putting head, a golf ball, and a target cup in a front of the golfer, in order to hit the golf ball with a forward sliding motion of the putting head.

* * * * *